US008424234B2

(12) United States Patent
Carlson et al.

(10) Patent No.: US 8,424,234 B2
(45) Date of Patent: Apr. 23, 2013

(54) ROTATING MOUNT FOR WEAPON SIGHT ACCESSORY

(75) Inventors: Mike Carlson, Saline, MI (US); Alan Charlton, Chelsea, MI (US); Fred Collin, Ann Arbor, MI (US); Michael L. Marino, Ann Arbor, MI (US)

(73) Assignee: OptiFlow, Inc., Ann Arbor, MI (US)

( * ) Notice: Subject to any disclaimer, the term of this patent is extended or adjusted under 35 U.S.C. 154(b) by 75 days.

(21) Appl. No.: 13/151,901

(22) Filed: Jun. 2, 2011

(65) Prior Publication Data

US 2011/0296731 A1 Dec. 8, 2011

Related U.S. Application Data

(60) Provisional application No. 61/351,031, filed on Jun. 3, 2010, provisional application No. 61/434,699, filed on Jan. 20, 2011.

(51) Int. Cl.
*F41C 27/00* (2006.01)

(52) U.S. Cl.
USPC ..... 42/90; 42/125

(58) Field of Classification Search ..... 42/90, 124–128
See application file for complete search history.

(56) References Cited

U.S. PATENT DOCUMENTS

| | | | | |
|---|---|---|---|---|
| 1,710,547 | A * | 4/1929 | Meise | 42/124 |
| 2,545,419 | A | 3/1951 | Williams | |
| 3,559,940 | A | 2/1971 | Kruzell | |
| 5,144,752 | A | 9/1992 | Boeke et al. | |
| 7,367,152 | B2 | 5/2008 | Samson | |
| 7,369,302 | B2 | 5/2008 | Gaber | |
| 7,730,655 | B2 | 6/2010 | Spuhr | |
| 7,870,688 | B1 | 1/2011 | Dasiukevich | |
| 7,908,782 | B1 * | 3/2011 | LaRue | 42/128 |
| 8,171,666 | B2 * | 5/2012 | Karagias | 42/124 |
| 2011/0296732 | A1 * | 12/2011 | Carlson et al. | 42/90 |

* cited by examiner

*Primary Examiner* — Michael David
(74) *Attorney, Agent, or Firm* — Gifford, Krass, Sprinkle, Anderson & Citkowski, P.C.

(57) ABSTRACT

A mount for mounting an accessory to a weapon includes a base portion with a forward edge and a rearward edge with a fore-aft axis extending therebetween. The fore-aft axis is parallel to the longitudinal axis of the weapon when attached thereto. An upper portion of the mount has a mounting surface for receiving an accessory. A pivot interconnects the base portion and the upper portion. The pivot has a pivot axis for rotation of the upper portion with respect to the base portion between a use position and a storage position. The upper portion in the use position is disposed above the base portion and in the storage position is disposed to a side of the base portion. The upper portion has a first edge that is a forward edge in the use position and a rearward edge in the storage position.

10 Claims, 21 Drawing Sheets

ROTATING MOUNT FOR WEAPON SIGHT ACCESSORY

REFERENCE TO RELATED APPLICATIONS

This utility patent application claims priority from. U.S. provisional patent application Ser. No. 61/434,699, filed Jan. 20, 2011, and of from U.S. provisional patent application Ser. No. 61/351,031, filed Jun. 3, 2010, the entire content of both of which are incorporated herein in their entirety.

FIELD OF THE INVENTION

The present invention relates generally to devices for mounting accessories to a weapon.

BACKGROUND OF THE INVENTION

A weapon such a rifle is often used in combination with one or more accessories, such as a sighting scope and/or accessories for a scope, such as a magnifier or night vision accessory. It is often desirable to quickly position a scope accessory, such as a magnifier into a use position, wherein it is aligned with a scope, when the accessory is needed. Likewise, it is desirable to quickly reposition such an accessory out of the way, or remove the accessory, when it is not needed.

SUMMARY OF THE INVENTION

A embodiment of the present invention provides a mount for mounting an accessory to a rail of a weapon. The rail defines a longitudinal axis and has an upper face and a pair of opposed side faces. The mount includes a base portion having an upper surface and a lower surface. The lower surface is configured to engage a rail of a weapon so as to attach the base portion thereto. The base portion had a forward edge and a rearward edge with a fore-aft axis extending therebetween. The fore-aft axis is parallel to the longitudinal axis of the rail when the base portion is attached to the rail. The mount also has an upper portion with an upper surface and a lower surface. The upper surface of the upper portion has a mounting surface for receiving an accessory. A pivot interconnects the base portion and the upper portion. The pivot has a pivot axis for rotation of the upper portion with respect to the base portion between a use position and a storage position. The upper portion in the use position is disposed above the base portion and in the storage position is disposed to a side of the base portion. The upper portion has a first edge that is a forward edge in the use position and a rearward edge in the storage position.

DETAILED DESCRIPTION OF THE INVENTION

A mount according to the present invention may take a variety of forms. Various embodiments of the present invention are shown in the Figures with the Figures representing scale drawings of some versions. However, the present invention is not limited to the illustrated embodiments.

Figure 2:
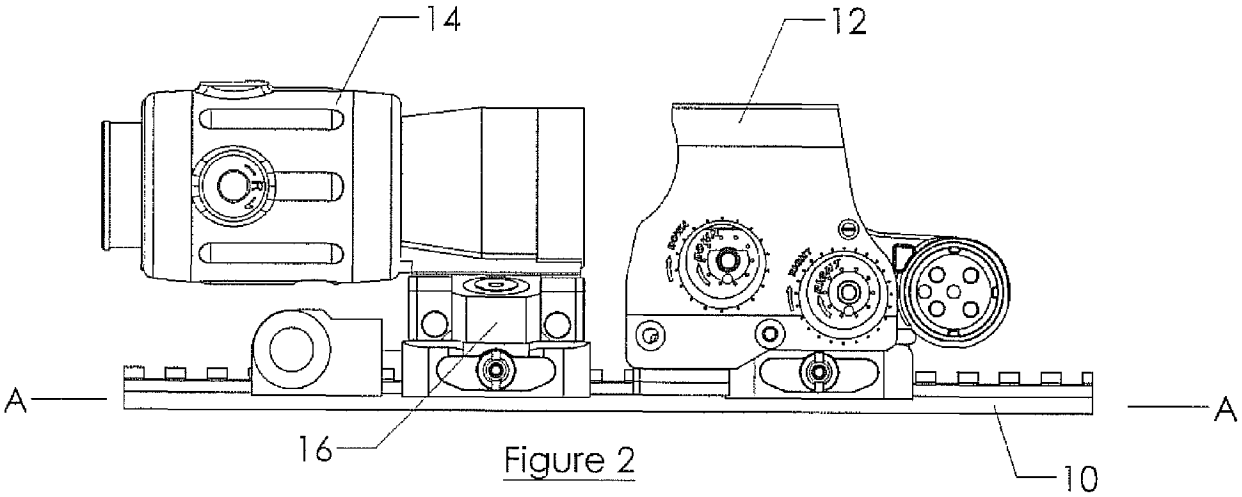
FIG. 2 is an opposite side elevation view of the mount, accessory and rail of FIG. 1.
Figure 1:
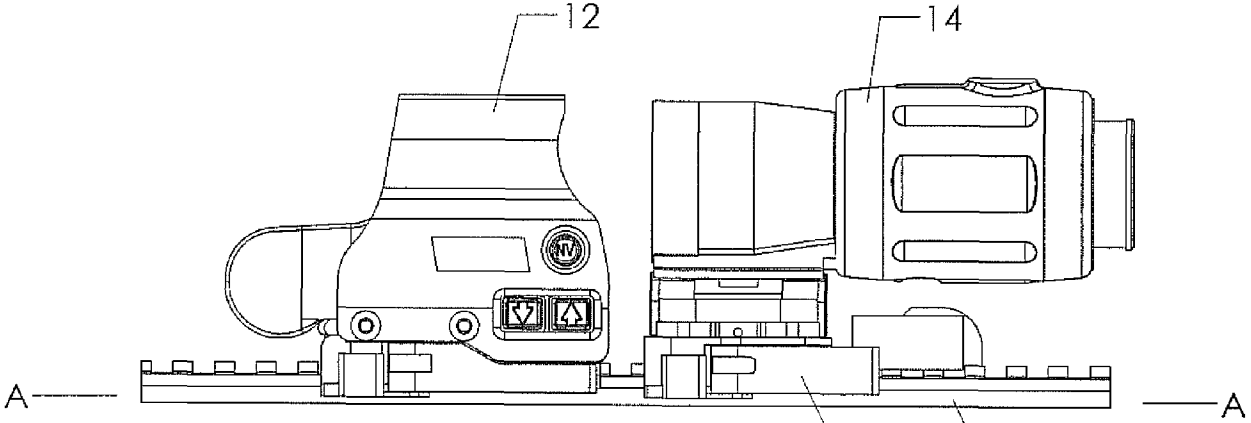
FIG. 1 is a side elevational view of a first embodiment of a mount in accordance with the present invention supporting an accessory on a rail of a weapon, with the mount shown in a use position.
Figure 3:
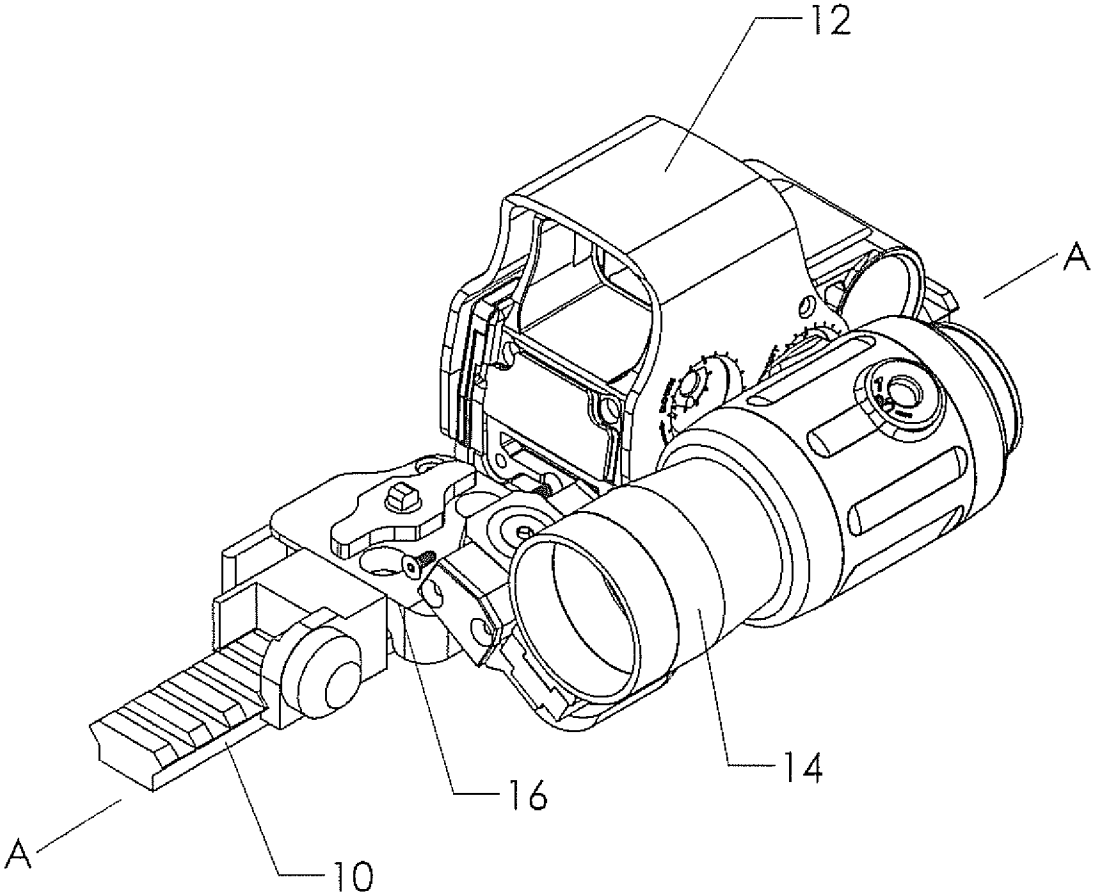
FIG. 3 is a perspective view of the mount, accessory and rail of FIG. 1 with the mount and accessory repositioned to a storage position.
Figure 5:
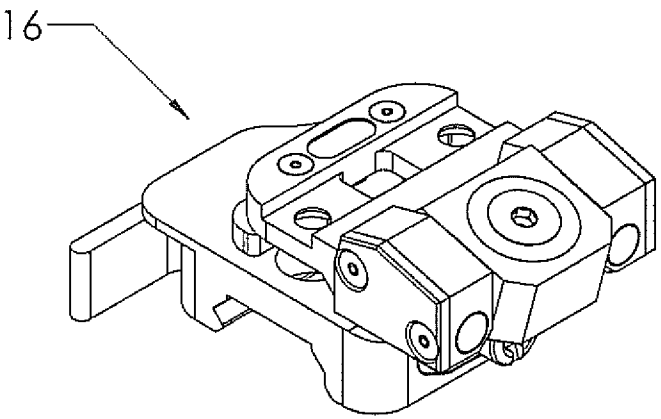
FIG. 5 is perspective view of the mount of FIG. 4 from a different angle.
Figure 4:
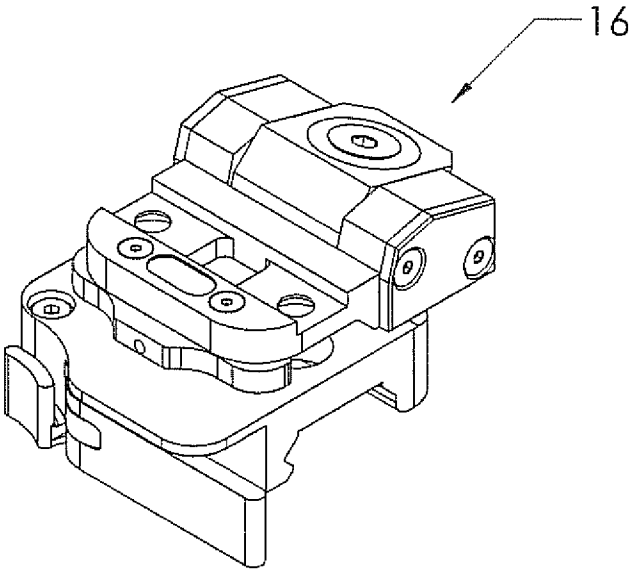
FIG. 4 is a perspective view of the mount of FIG. 1, without the rail or accessory, in the use position.

Referring to FIGS. 1-7, a first embodiment of the present invention will be discussed. The present invention provides a mount for mounting an accessory to a rail of a weapon, such as a rifle. An example of a rail is shown at 10 in FIGS. 1-3. The rail 10 may be said to be elongated and to generally define a longitudinal axis A. The rail may be said to have an upper surface and a pair of opposed side faces. Typically, the rail is provided along an upper surface of a weapon, such as a rifle. While the illustrated rail 10 is typical of rails used on many weapons, the present invention is not limited to this rail design, In addition, embodiments of the present invention may be provided that do not require a rail, but instead attach directly to a weapon in other ways. Also shown in FIGS. 1-3 is a sighting device 12 that is mounted to the rail 10. The sighting device 12 is merely exemplary and does not form part of the invention. The sighting device 12 may be a scope or laser sight and may be used for targeting purposes. The sighting device 12 may be used alone or in combination with a variety of accessories. One such accessory is shown at 14. The illustrated accessory 14 is a magnifying device for use with a sighting device 12. The accessory 14 does not form part of the present invention but is used therewith. Other accessories, including but not limited to night vision accessories, may be used instead of the illustrated accessory 14. In the illustrated embodiment, the mount is an independent device to which the accessory or components of the accessory are attached. Alternatively, a mount according to the present invention may form a component of an accessory, such as forming part of its base.

In FIGS. 1 and 2, the accessory 14 is shown in the use position, wherein it is aligned with the sighting device 12 for use therewith. In FIG. 3, the accessory 14 is shown in a storage position wherein it is not aligned with the sighting device 12.

A mount in accordance with an embodiment of the present invention is shown at 16. The mount 16 mounts the accessory 14 to the rail 10. The mount 16 is shown without the rail or accessory in FIGS. 4 and 5, wherein it is in the use position, corresponding to the use position of the accessory. The mount 16 also has a storage position, corresponding to the storage position of the accessory.

Figure 6:
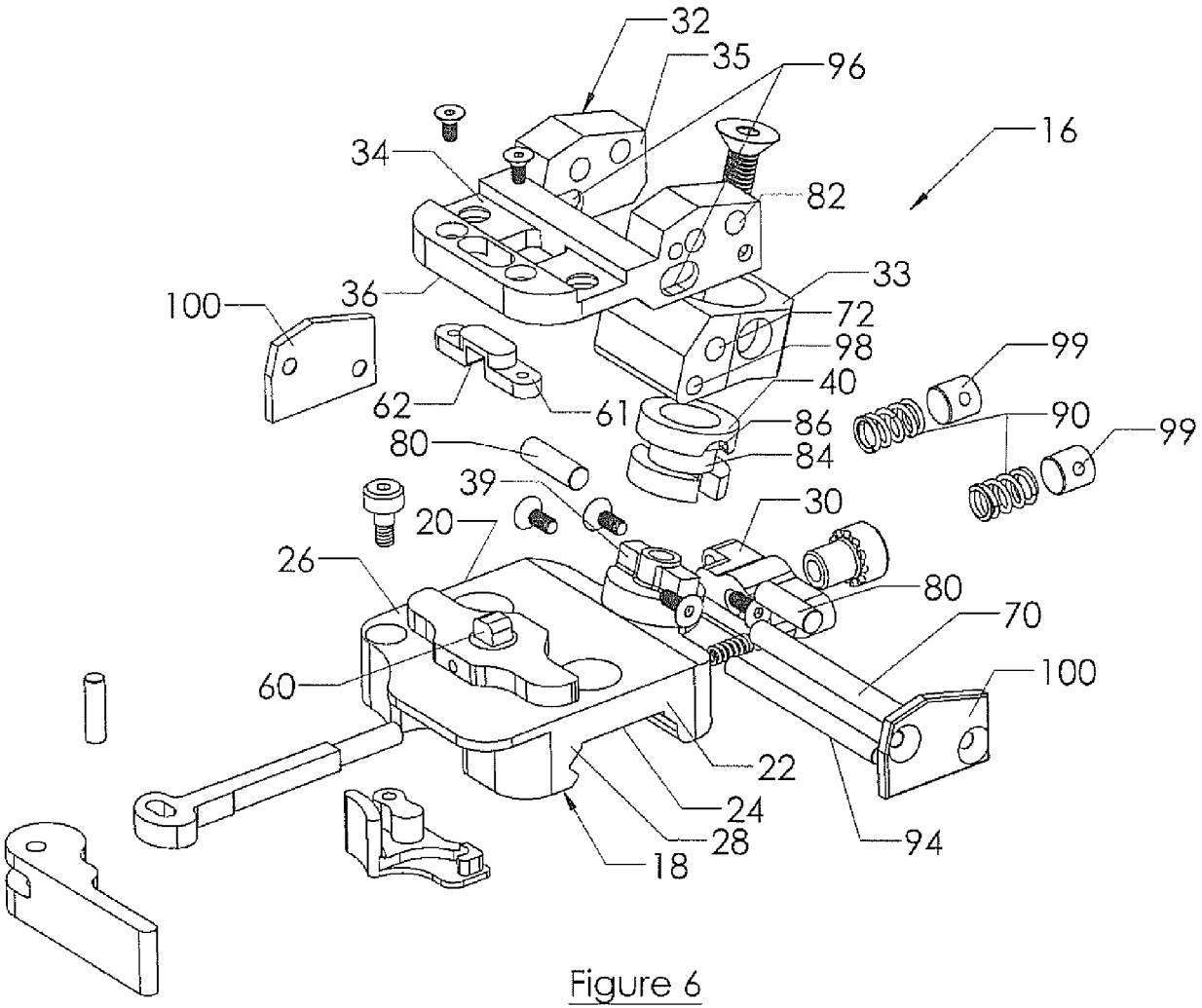
FIG. 6 is an exploded perspective view of the mount shown in FIGS. 1-5, showing the component pieces of the mount.
Figure 7:
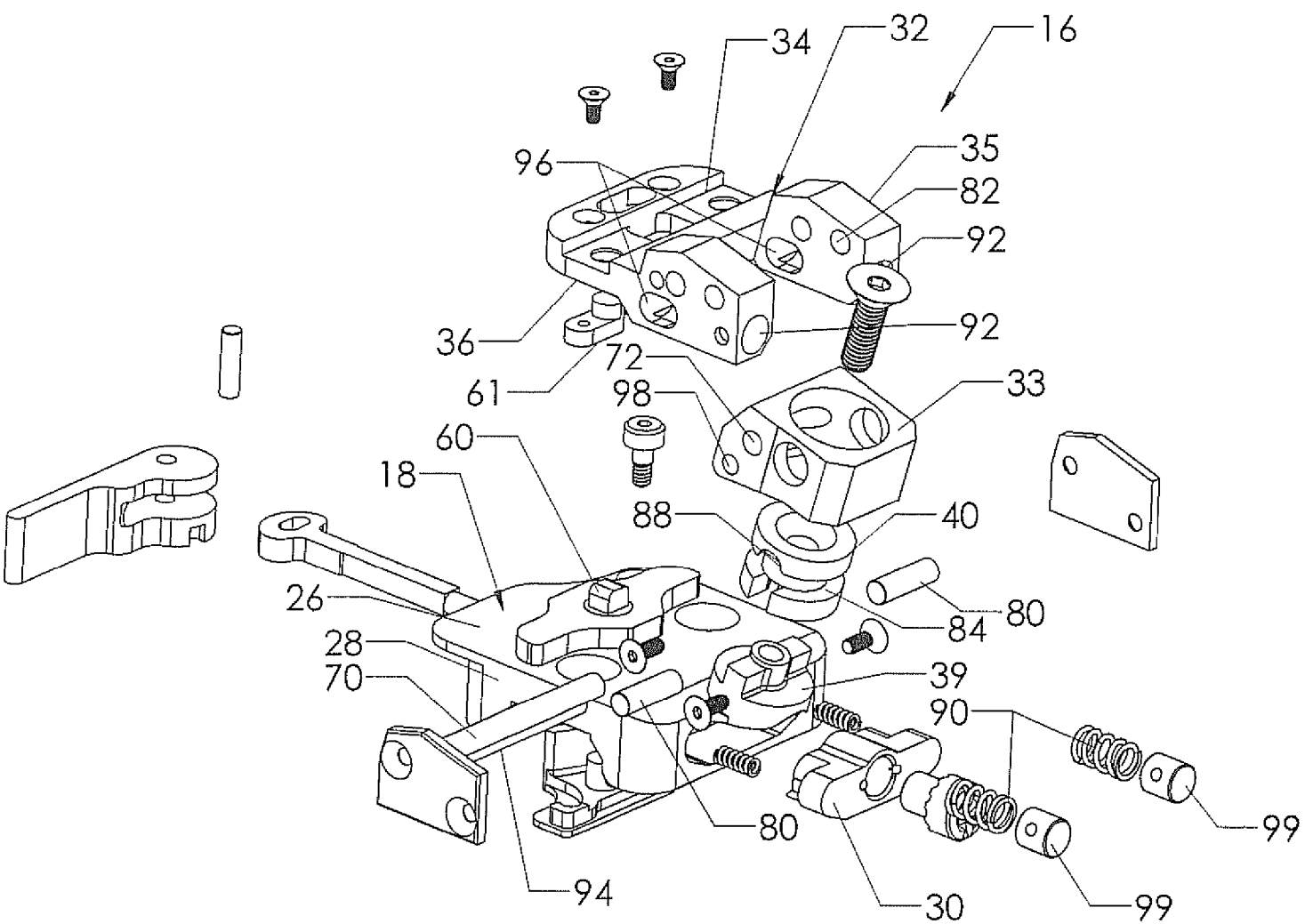
FIG. 7 is another exploded perspective view of the mount, from a different angle.

The components of the mount 16 are best shown in the exploded views of FIGS. 6 and 7, which will be discussed in more detail. The mount 16 includes a base portion 18 and an upper portion 32. As illustrated, the base portion 18 has a lower surface that is configured to engage the rail 10 so as to attach the base portion thereto. The base portion 18 also has an opposed upper surface. The base portion has a forward edge 20 and a rearward edge 22 and may be said to have a fore-aft axis that extends between the forward and rearward edges. When the base portion 18 is mounted on the rail 10, the fore-aft axis is parallel to the longitudinal axis A of the rail 10. As will be clear to those of skill in the art, the base portion 18 may engage the rail in a variety of ways or may attach to the weapon in other ways. In the illustrated embodiment, a quick connect design is provided. In this design, the base portion has a first side portion 28 and an opposite second side portion 30. The second side portion 30 in the illustrated embodiment is movable relative to the first side portion 28 so as to selectively grip the rail of the weapon. More details on this quick connect design are shown in Applicants' copending U.S. patent application Ser. No. 12/819,506, the entire contents of which is incorporated herein by reference.

The upper portion 32 pivots between the use position and the storage position. In this embodiment, the pivot is defined by a pivot member 40 which is mounted to a pivot boss 39 that is part of the base portion 18. The pivot boss 39 and pivot member 40 define a pivot axis that is angled outwardly with respect to vertical (assuming the upper surface of the base portion 18 defines a horizontal plane). As such, pivoting of the upper portion 32 around the pivot axis defined by the pivot member 40 causes the upper portion to move to a storage position that is beside the base portion 18 and angled downwardly with respect to the horizontal plane defined by the base portion 18.

The base portion 18 has an upper surface 26 that generally defines a horizontal plane and a lower surface 24. The upper portion 32 has a lower surface 36, and at least part of this lower surface is disposed generally flush with at least part of the upper surface 26 of the base portion 18 when the upper portion 32 is in the use position. The upper portion 32 further has an upper surface 34 that forms a mounting surface for the accessory. The upper portion 32 is aligned with and retained in the use position by an alignment pin 60 that extends upwardly from the base portion 18. The alignment pin 60 engages in an opening 62 in the upper portion 32. In the illustrated embodiment, the opening 62 is part of a reinforcement 61 that is interconnected with the remainder of the upper portion 32. By forming the reinforcement 61 a separate piece, it may be formed out of a different material. Alternatively, it may be integral with the remainder of the upper portion. Likewise, the alignment pin 60 may be a separate piece and/or formed out of a different material.

In order to unlock or disengage the upper portion 32 from the use position and pivot it to the storage position, the upper portion is twisted or rotated about a longitudinal axis so as to lift the upper portion off of the alignment pin 60. In order to accomplish this, the upper portion 32 is formed as two pieces. The upper portion 32 includes a first piece 33 with an opening that is received on the pivot member 40 and a second piece 35 that is pivoted to the first piece 33 about a longitudinal axis. A pivot pin 70 interconnects the first piece 33 and the second piece 35 and defines the longitudinal axis. Pin 70 also passes through hole 72, engages slot 84 in part 40, and retains the upper portion 32 to the base portion 18. The pivot pin passes through openings in the first piece 33 and the second piece 35. The mount further has two locking pins 80 that are received in locking pin holes 82 in the second piece 35 of the upper portion 32. These locking pins each engage a guide slot 84 in the pivot member 40. The guide slot 84 includes a locking notch 86 and an opposite locking notch 88. One of the pins 80 engages each of the notches 86 and 88 when the upper portion 32 is in the use position. The pins 80 trade places and engage the other of the locking notches when the upper portion 32 is in the storage position. When the second piece 35 of the upper portion 32 is pivoted about the pivot pin 70, the locking pins 80 moves downwardly out of the notches 86 and 88. The upper portion 32 is then rotated about the pivot member 40 with the locking pins riding in the slot 84. Once the upper portion 32 reaches the storage position, which is rotated 180 degrees from the use position in this embodiment, the locking pins 80 engage the other locking notch, thereby retaining the upper portion 32 in the storage position.

The upper portion 32 is spring biased such that the second piece 35 is biased downwardly so as to engage with the alignment pin 60 and such that the locking pins engage the notches 86 and 88. This may be accomplished in a variety of ways. In the illustrated embodiment, springs 90 are disposed in spring holes 92 in the second portion 35. The springs engage a spring pin 94 that extends generally parallel to the pivot pin 70. The spring pin 94 passes through slots 96 in the second portion 35 and hole 98 in the first portion 33. The springs 90 are held in place by retaining pieces 99. The pivot pin 70 and spring pin 94 are covered and held in place by covers 100 that are attached at opposite sides of the second piece 35 of the upper portion 32.

Figure 8:
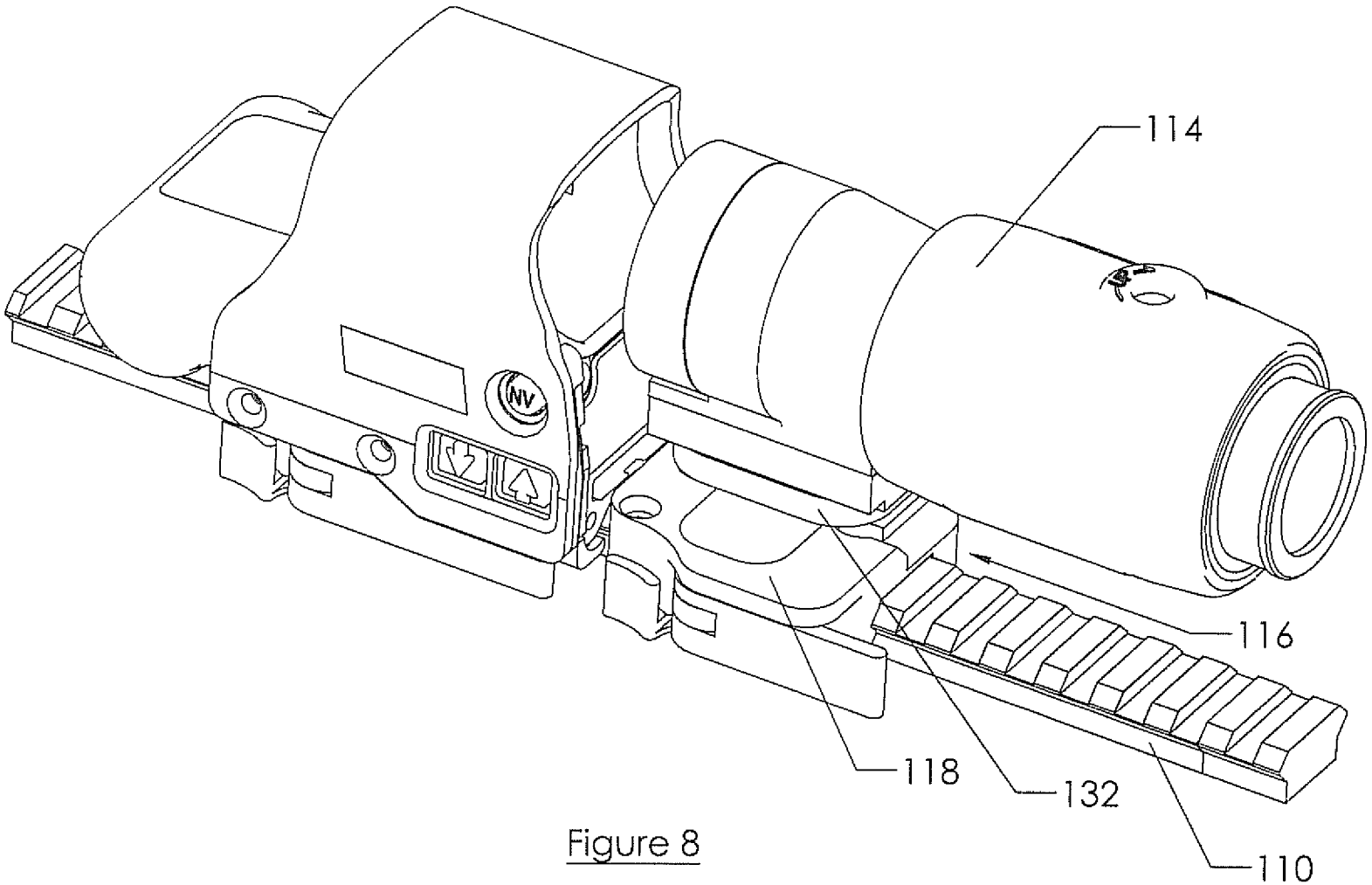
FIG. 8 is a perspective view of a second embodiment of a mount in accordance with the present invention supporting an accessory on a rail of a weapon, with the mount and accessory shown in a use position.
Figure 9:
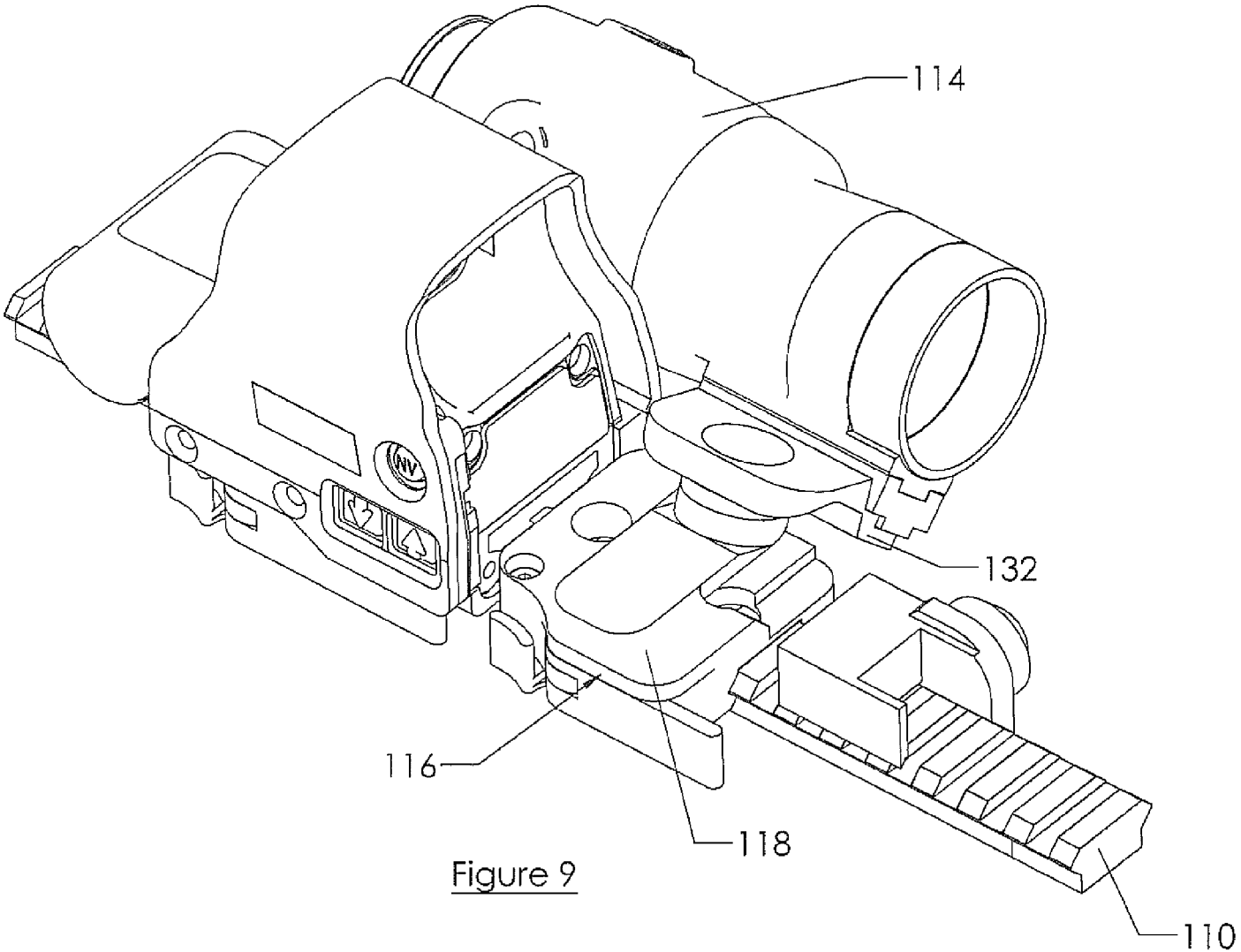
FIG. 9 is a perspective view of the mount, accessory and rail of FIG. 8 in a storage position.
Figure 10:
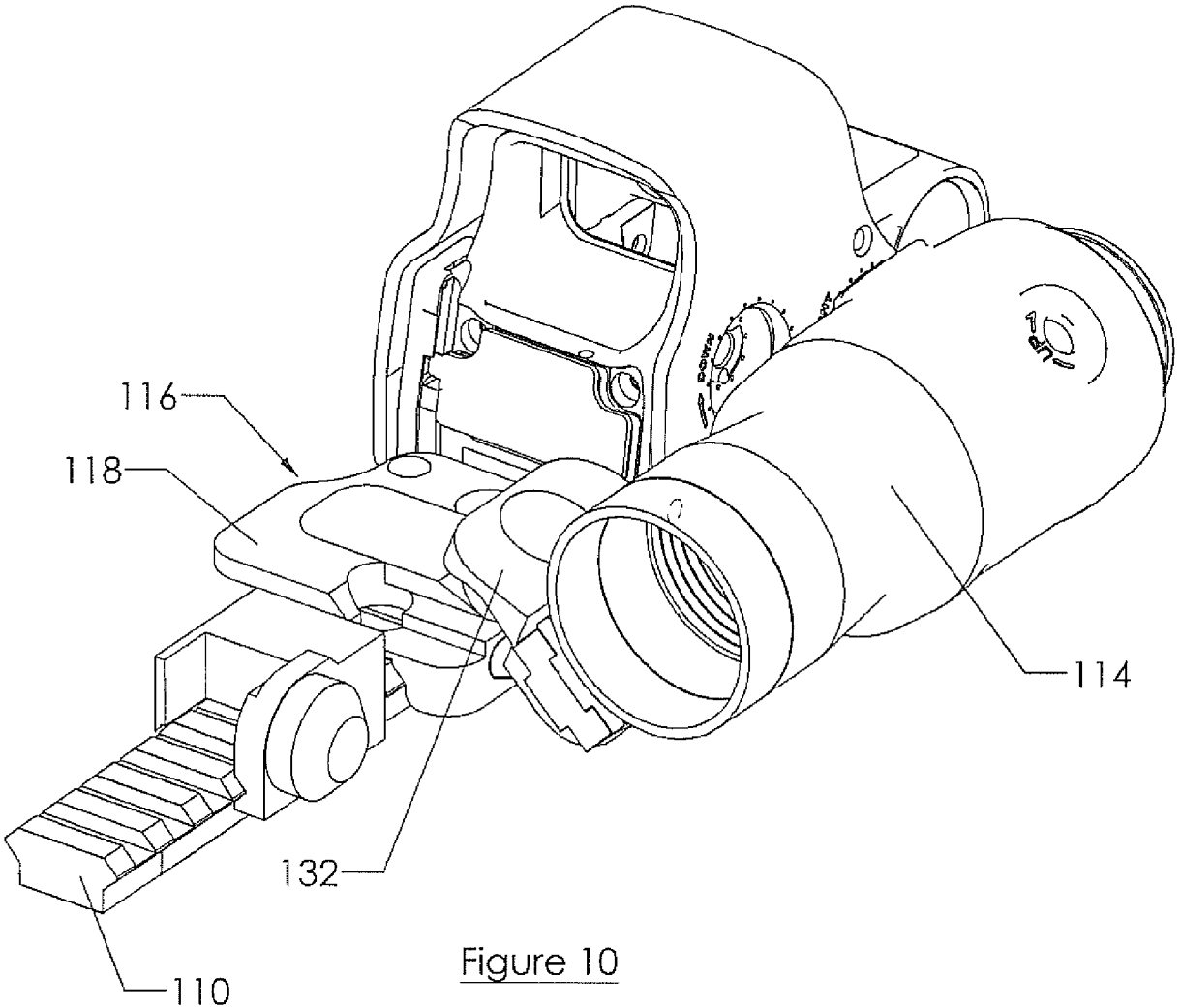
FIG. 10 is another perspective view of the mount of FIG. 9, from a different angle.
Figure 11:
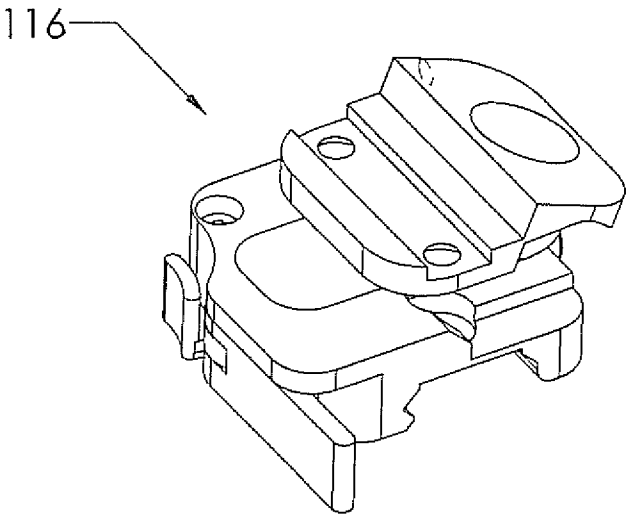
FIG. 11 is a perspective view of the mount of FIGS. 8-10 without the rail or the accessory, in the use position.
Figure 12:
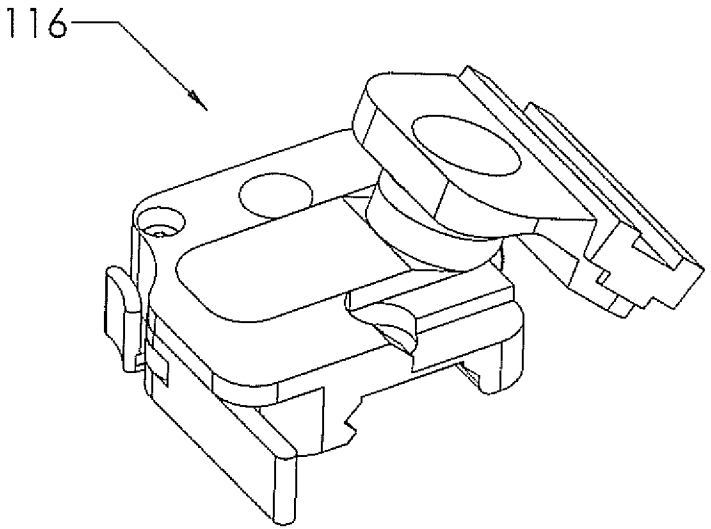
FIG. 12 is a perspective view similar to FIG. 11, with the mount in the storage position.
Figure 13:
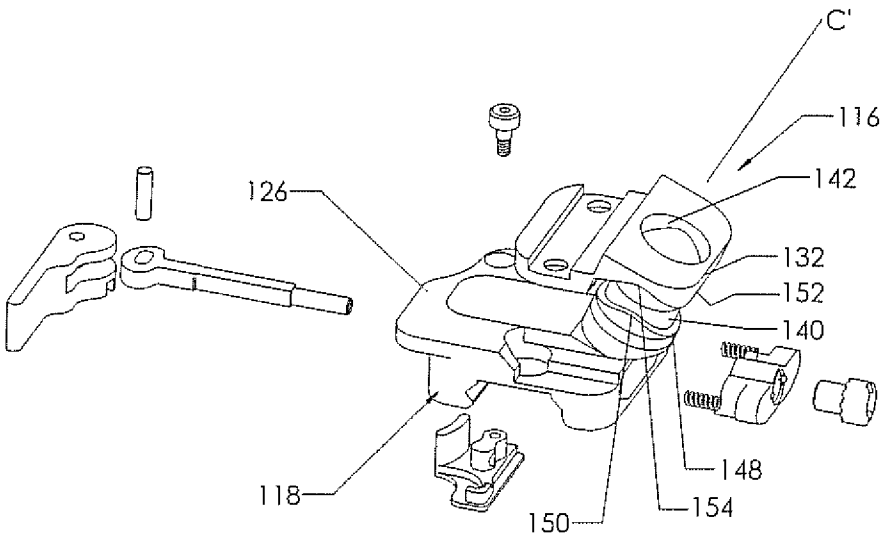
FIG. 13 is an exploded perspective view of the mount of FIGS. 8-12.
Figure 14:
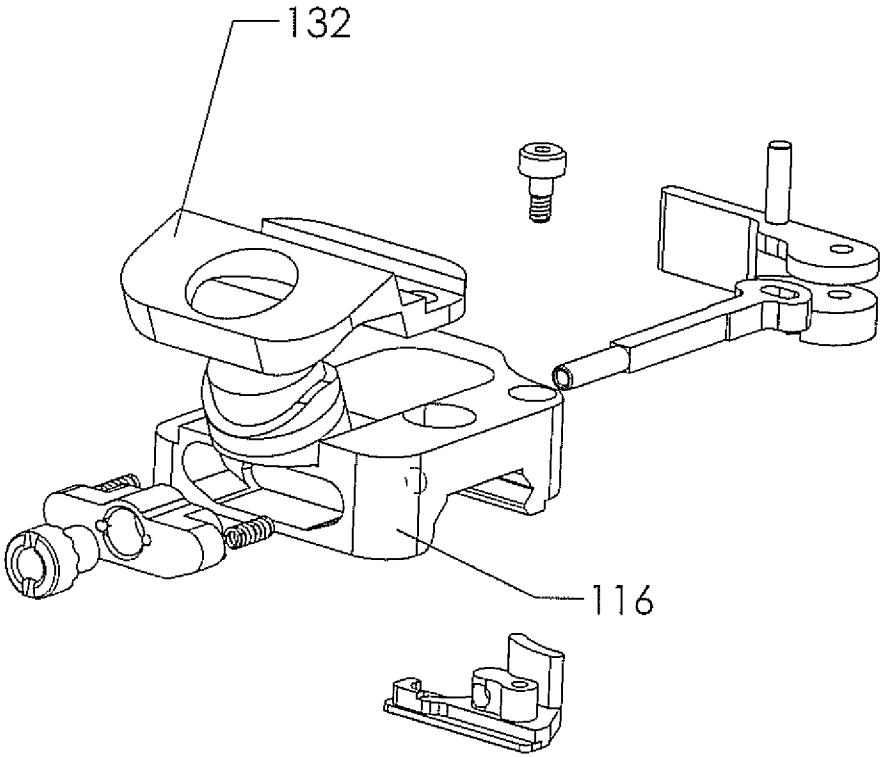
FIG. 14 is another exploded perspective view of the mount of FIGS. 8-13.

Referring now to FIGS. 8-14, a second embodiment of a mount 116 in accordance with the present invention will be described. FIGS. 8-10 show the mount mounted to a rail 110 with an accessory 114 attached to the mount. The mount and accessory are shown in the use position in FIG. 8, wherein the upper portion 132 rests atop the base portion 118, and in the storage position in FIGS. 9 and 10, wherein the upper portion 132 is rotated to the side. The mount 116 is shown by itself in FIGS. 11 and 12, in the use position and storage position, respectively. FIG. 13 provides a partially exploded view of the mount and FIG. 14 a more completely exploded view from a different angle. FIGS. 13 and 14 best shows portions and components of the mount 116, including a base portion 118 and an upper portion 132. Some components of the mount 116 have been left out of FIGS. 13 and 14 to simplify the drawings. The mount 116 differs from the mount 16 in several ways, though the primary difference is in how the upper portion is released from the use position, As with the first embodiment, the pivot is defined by a pivot shaft 140 extending upwardly from the base portion 118. In this embodiment, the pivot shaft 140 is received into an aperture 142 in the upper portion 132.

Referring again to FIGS. 9 and 10, the mount 116, with an accessory attached, is shown in a storage position wherein the upper portion is pivoted around the pivot axis. Because the pivot axis is disposed at an outwardly inclined angle, the upper portion 132 pivots into a downwardly sloping position. In this position, part of the upper portion 132 extends below part of the base portion 118.

Referring again to FIG. 13, the base portion 118 and upper portion 132 have corresponding pivot surfaces 148 and 152, respectively, defined thereon. The surfaces slide against one another as the upper portion 132 is pivoted between its two positions. One of the surfaces may have a raised portion 150 while the other has a corresponding recess 154. In the illustrated embodiment, both surfaces are smoothly contoured such that they slide against one another and smoothly push the upper portion 132 upwardly along the axis C' when the upper portion 132 is between the use and storage positions. A second recess may be provided on the opposite side of one of the surfaces so that the raised portion 150 may be received in a recess in both the use and storage positions, thereby positive locating the upper portion 132. As will be clear to those of skill in the art, the interacting pivot surfaces, with raised portions and recesses, may be provided in a variety of ways, or may be omitted entirely, from any of the embodiments of the present invention.

Figure 15:
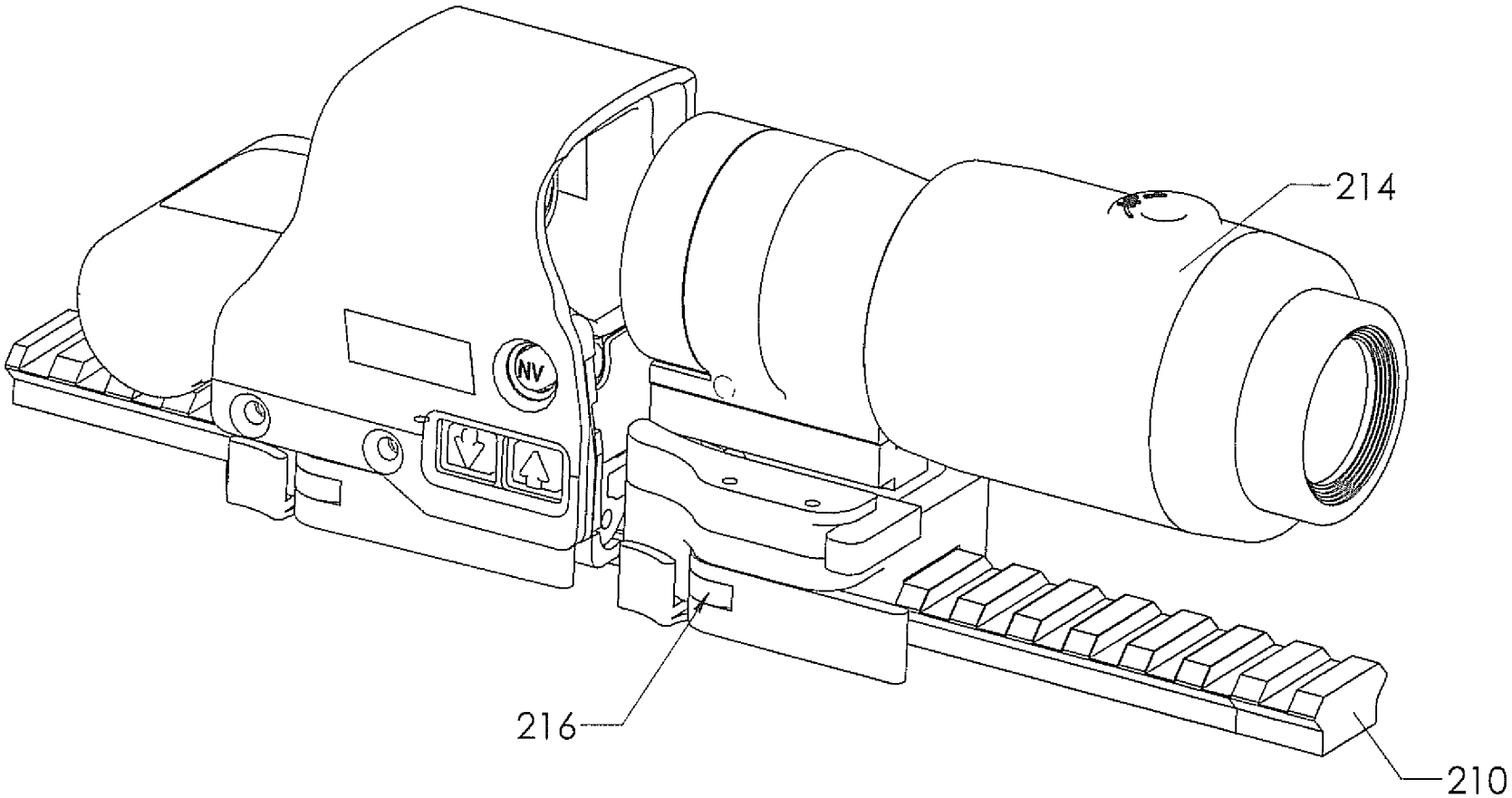
FIG. 15 is a perspective view of a third embodiment of a mount in accordance with the present invention supporting an accessory on a rail of a weapon, with the mount and accessory shown in a use position.
Figure 16:
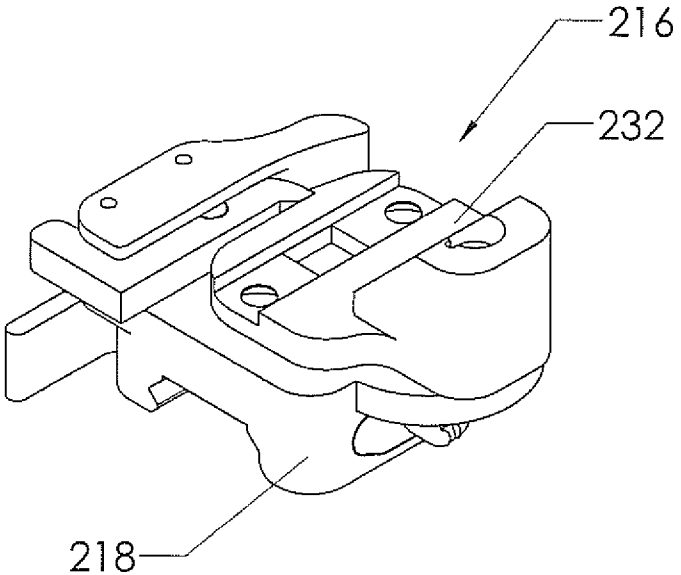
FIG. 16 is a perspective view of the mount of FIG. 15 without the accessory or rail, in the use position.
Figure 17:
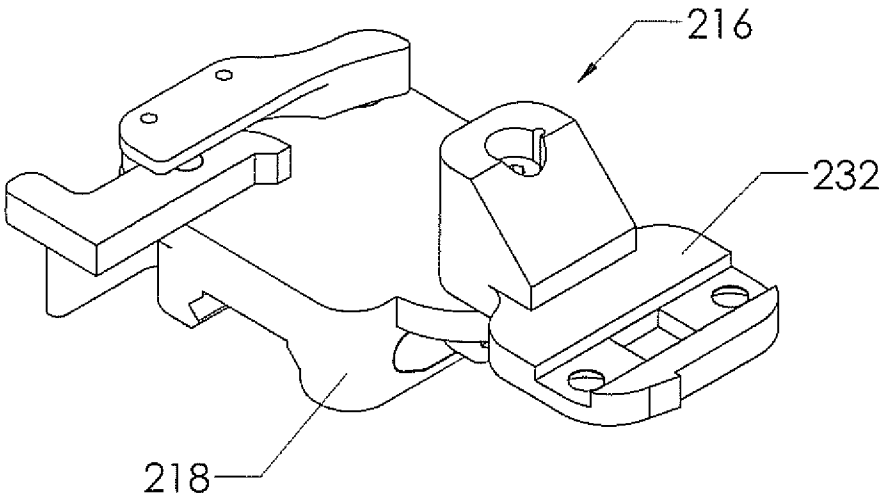
FIG. 17 is a perspective view similar to FIG. 16, with the mount in the storage position.
Figure 18:
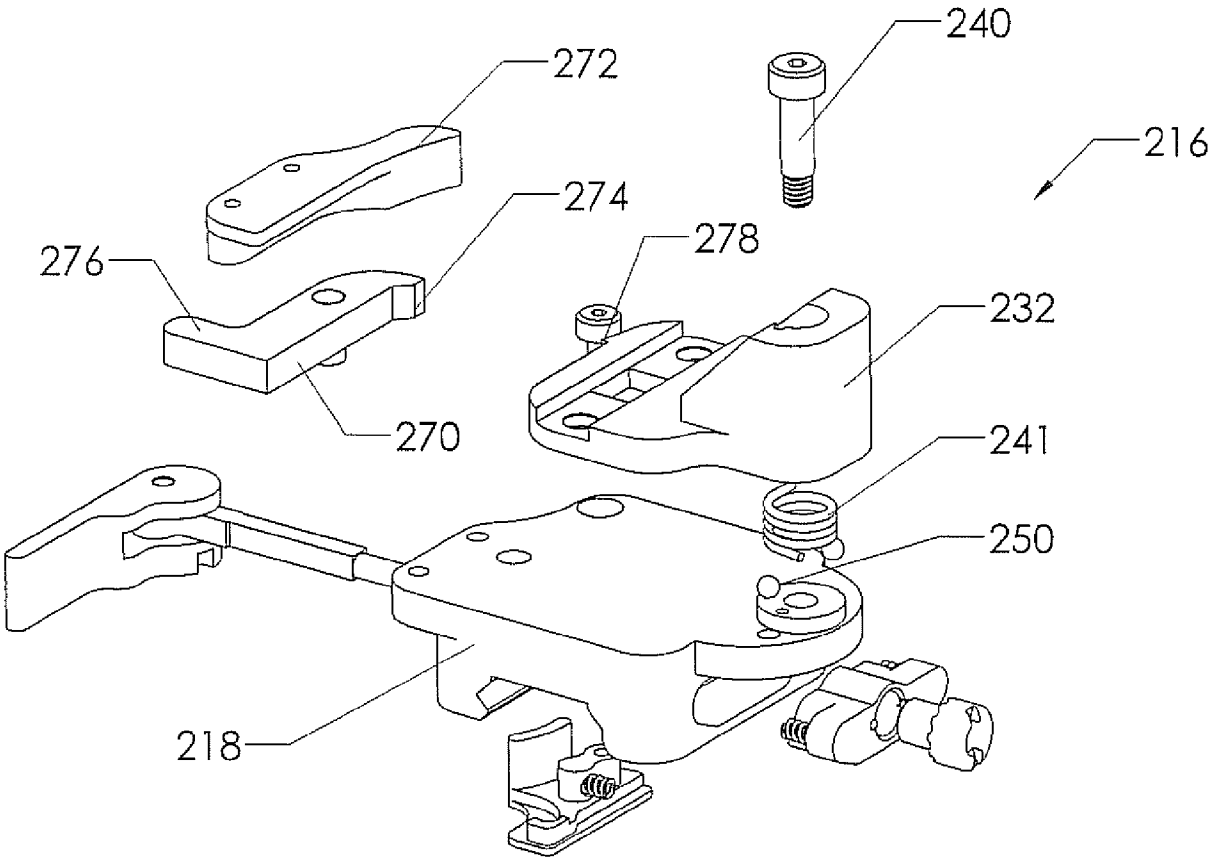
FIG. 18 is an exploded perspective view of the mount of FIGS. 15-17 showing components of the mount.

Referring now to FIGS. 15-18, a third embodiment of a mount in accordance with the present invention will be discussed. FIG. 15 shows the mount 216, with an accessory 214 attached thereto, mounted to a rail 210, with the mount and accessory in a use position. FIG. 16 shows the mount 216 by itself, in the use position with the upper portion 232 resting on the base portion 218. FIG. 17 shows the mount in the storage position, wherein the upper portion 232 has been rotated about a pivot axis. FIG. 18 provides an exploded view and best shows the components of the mount 216. The upper portion 232 pivots between the use position and the storage position around a pivot that is defined by a bolt 240. Unlike the prior embodiments, the pivot axis, defined by the bolt 240, is generally vertical, and not angled outwardly. Therefore, the upper portion 232 does not move downwardly as it rotates to the storage position. As will be clear to those of skill in the art, this may be desirable for some applications. In this embodiment, a spring 241 biases the upper portion 232 from the use position towards the storage position. A detent 250 may be provided for helping position the upper portion in the use position and/or storage position. As will be clear to those of skill in the art, the detent 250 may interact with a recess or other feature, or a detent may be provided in other ways.

In this embodiment, the detent 250 causes the upper portion to raise upwardly when it moves from the use to the storage position. This helps provide some clearance for the accessory as it pivots to the storage position.

As shown in FIG. 18, a lever 270 is provided, and is pivotally supported with respect to the upper portion 232. A support 272 is disposed above the lever and helps to mount it to the upper portion 232. A spring, not shown, may be positioned between the lever and support to bias the lever into engagement with the upper portion. An engagement end 274 of the lever 270 engages a side of the upper portion 232 when the upper portion is in the use position to retain the upper portion in the use position. The upper portion may have a tab 278 that interacts with the engagement end 274 to help retain the upper portion in the use position. Alternatively, a recess may be provided. The lever 270 has an opposite end 276 that is depressed by a user to move the engagement end away from the upper portion 232. Other approaches may also be used for latching or retaining the upper portion in the use position. When the lever 270 is moved by a user, the engagement end 274 moves away from the upper portion 232 and the spring 241 moves the upper portion to the storage position.

As shown, the upper portion may have a smooth lower surface and the base portion may have a corresponding smooth upper surface, so that the upper portion sits flat on the base portion in the use position. Alternatively, features may be provided for interaction between the upper portion and base portion to locate them in the use position.

Figure 19:
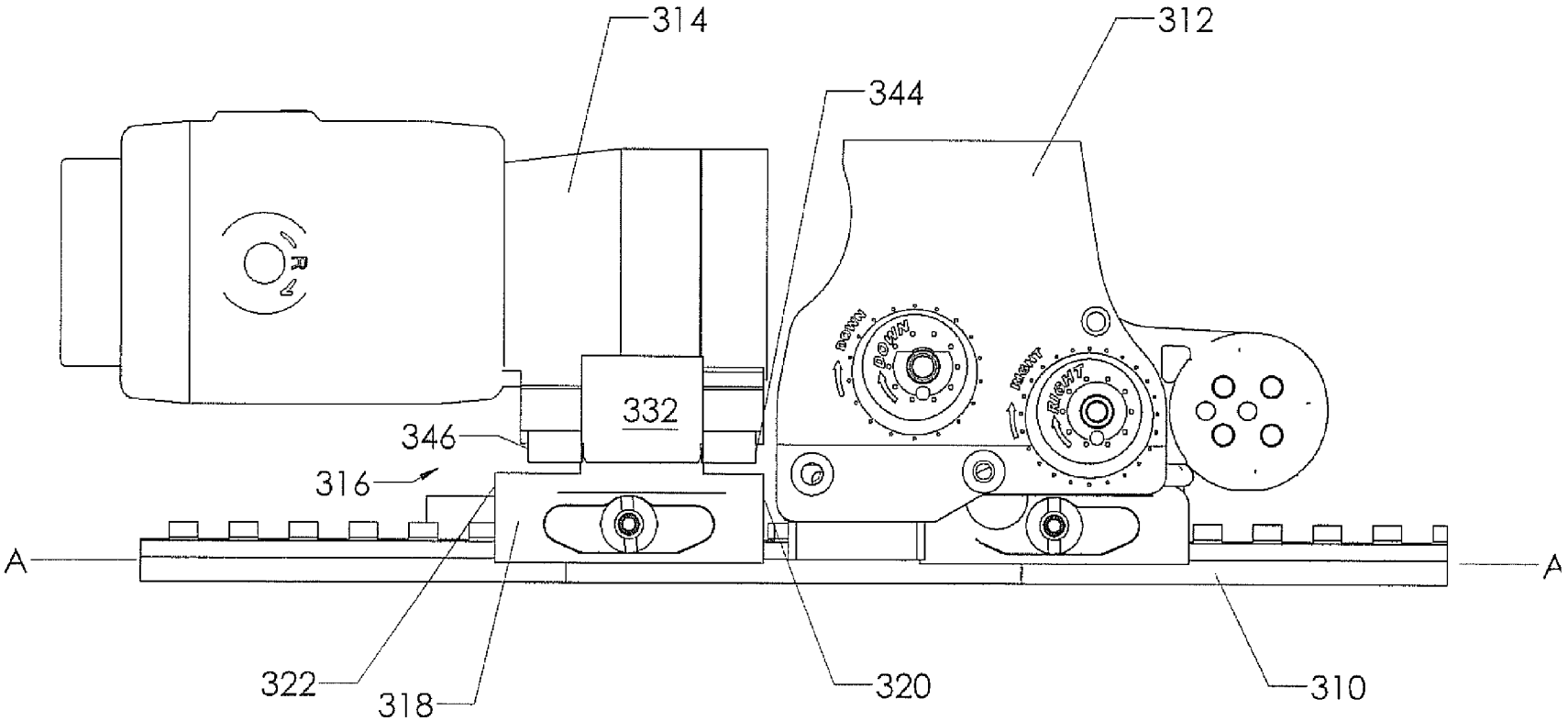
FIG. 19 is a side view of a fourth embodiment of a mount in accordance with the present invention supporting an accessory on a rail of a weapon, with the mount and accessory shown in a use position.
Figure 20:
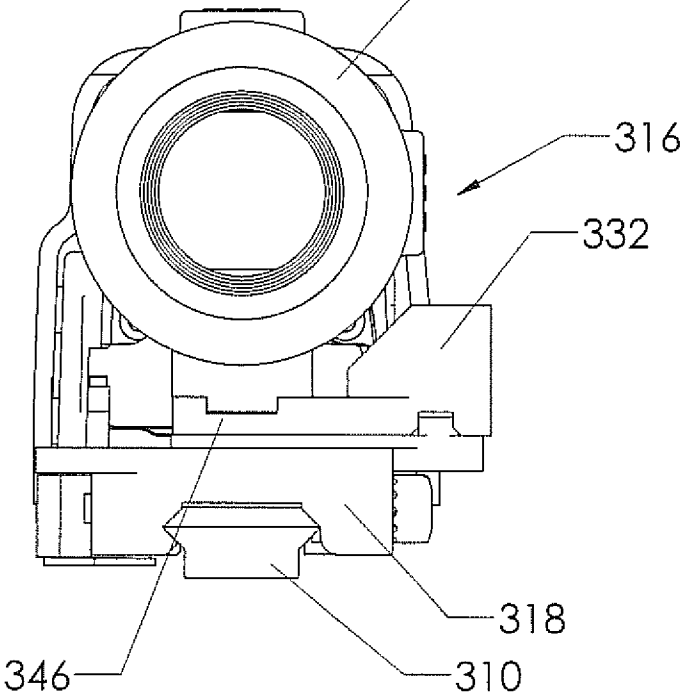
FIG. 20 is an end view of the mount, accessory and rail of FIG. 19.
Figure 21:
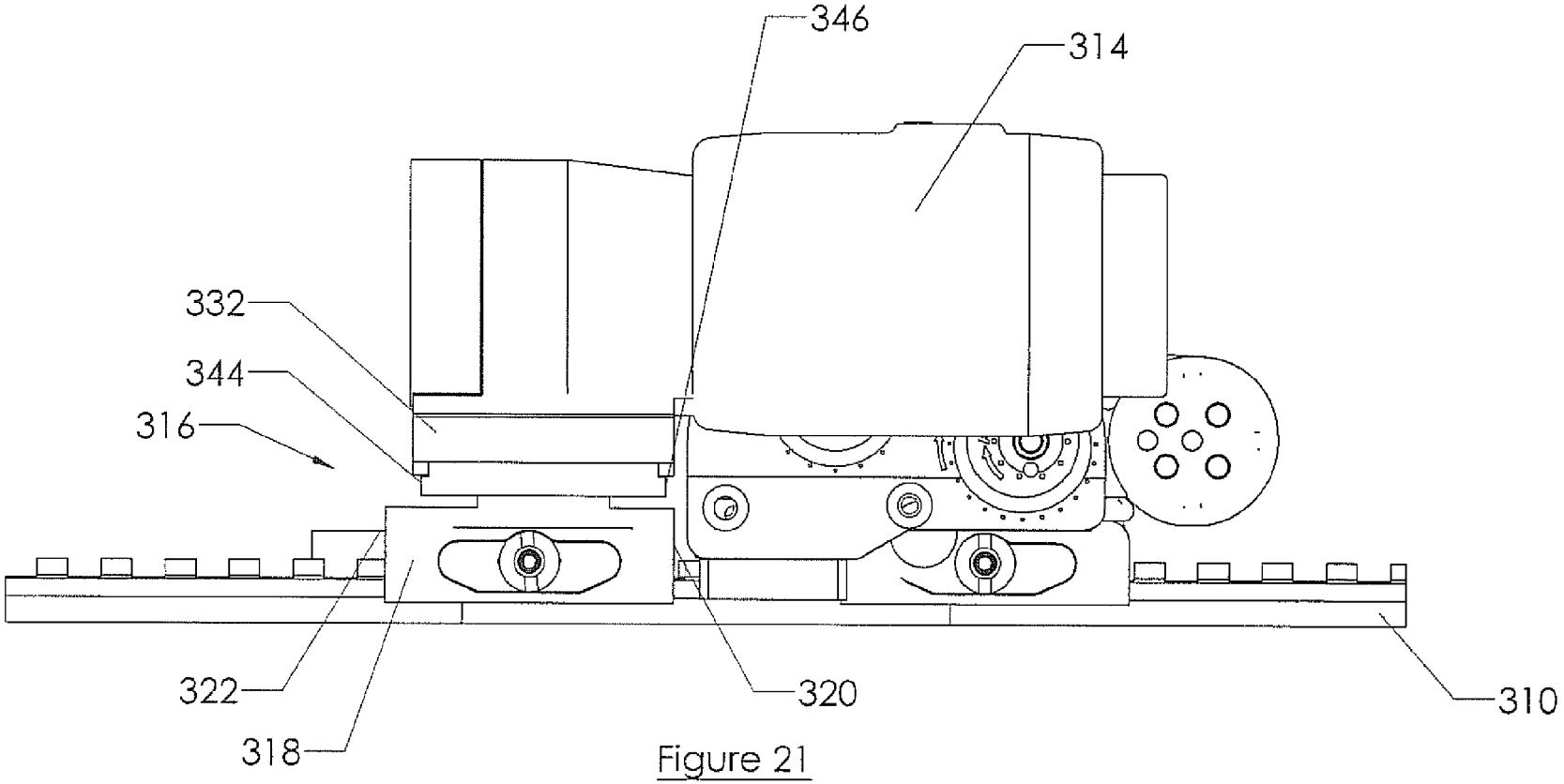
FIG. 21 is a side view of the mount, accessory and rail of FIGS. 19 and 20, in the storage position.
Figure 22:
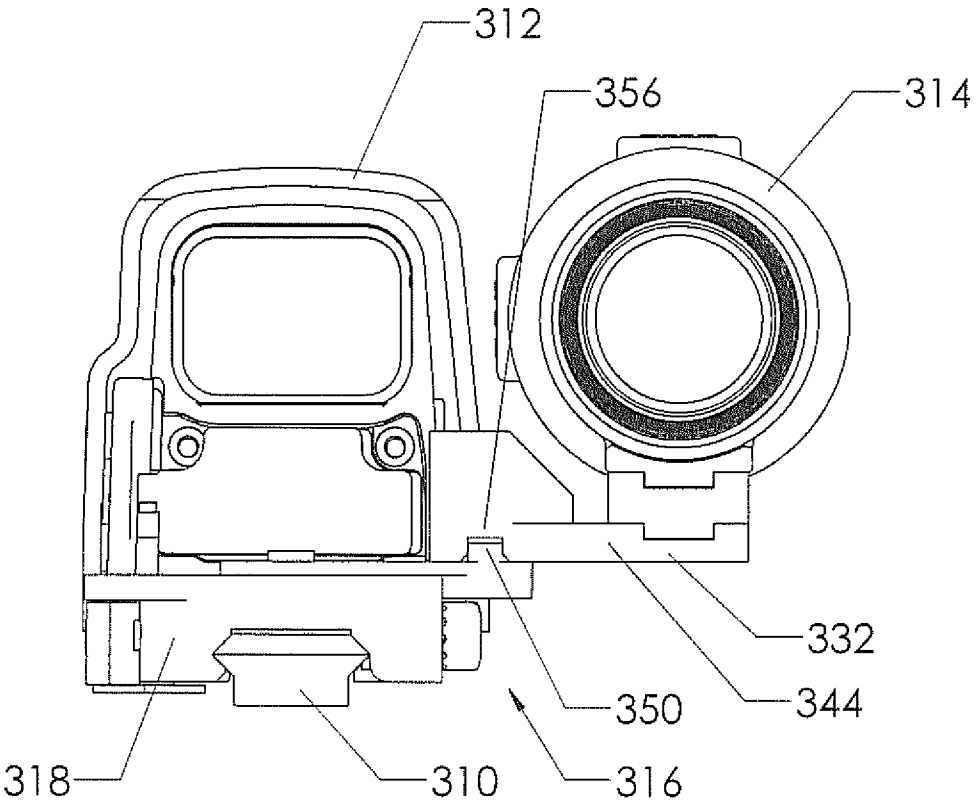
FIG. 22 is an end view of the mount, accessory and rail of FIG. 21.

Referring now to FIGS. 19-23, a fourth embodiment of the present invention will be discussed. In FIGS. 19 and 20, an accessory 314 is shown in the use position, wherein it is aligned with a sighting device 312 for use therewith. In FIGS. 21 and 22, the accessory 314 is shown in a storage position wherein it is not aligned with the sighting device 312.

A mount in accordance with this embodiment of the present invention is shown at 316. The mount 316 mounts the accessory 314 to the rail 310. The mount 316 has a use position, illustrated in FIGS. 19 and 20, wherein the accessory 314 is in its use position. The mount 316 also has a storage position, illustrated in FIGS. 21 and 22, wherein the accessory is positioned in the storage position.

The mount 316 includes a base portion 318. As illustrated, the base portion 318 has a lower surface that is configured to engage the rail 310 so as to attach the base portion thereto. The base portion 318 also has an opposed upper surface. The base portion has a forward edge 320 and a rearward edge 322 and may be said to have a fore-aft axis that extends between the forward and rearward edges. When the base portion 318 is mounted on the rail 310, the fore-aft axis is parallel to the longitudinal axis A of the rail 310.

Figure 23:
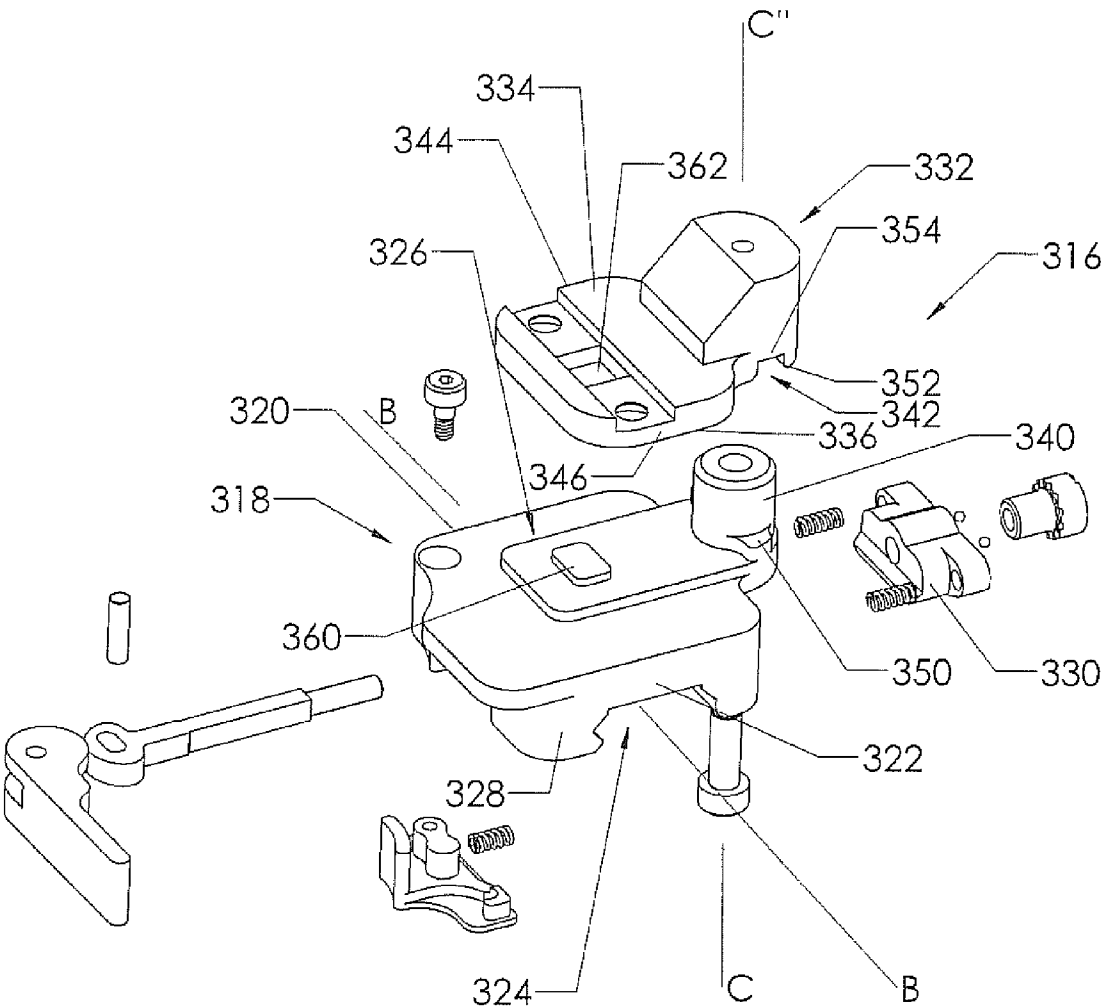
FIG. 23 is an exploded perspective view of the mount of FIGS. 19-20.

Referring now to FIG. 23, the base 318 may be seen in more detail. In this drawing, the lower surface is labeled as 324 and the upper surface is labeled as 326. The fore-aft axis is shown at B. As will be clear to those of skill in the art, the base portion 318 may engage the rail in a variety of ways. In the illustrated embodiment, a quick connect design is provided. In this design, the base portion has a first side portion 328 and an opposite second side portion 330. The second side portion 330 in the illustrated embodiment is movable relative to the first side portion 328 so as to selectively grip the rail of the weapon.

The mount 316 further includes an upper portion 332. The upper portion has an upper surface 334 and an opposed lower surface 336. The upper surface 334 forms a mounting surface for receiving the accessory 314.

The upper portion 332 is illustrated in the use position in FIGS. 19 and 20. In this position, the upper portion is directly above the lower portion. The lower surface 336 of the upper portion 332 may rest on the upper surface 326 of the lower portion 318 in the use position so as to provide secure positioning and stability. As best shown in FIG. 23, a pivot interconnects the base portion 318 and the upper portion 332 so as to allow the upper portion 332 to pivot between the use position of FIGS. 19 and 20 and the storage position of FIGS. 21 and 22. In the illustrated embodiment, the pivot is formed by a pivot shaft 340 that extends upwardly from the base portion 318. The pivot shaft 340 is received in an aperture 342 in the upper portion 332. The pivot shaft and aperture cooperate to form the pivot. In the illustrated embodiment, a pivot axis C" is defined by the cooperation of the pivot shaft and aperture. The pivot axis C" in the illustrated embodiment is generally vertical. The upper surface 326 of the base portion 318 may be said to generally define a horizontal plane. The pivot axis C" is therefore generally perpendicular to this plane.

The upper portion 332 may be said to have a first edge 344 and an opposed second edge 346. In the use position of FIGS. 19 and 20, and FIG. 23, the first edge 344 forms a forward edge of the upper portion 332 and the second edge 346 forms a rearward edge. When the upper portion 332 pivots about the axis C" to the storage position, the first edge 344 becomes a rearward edge and the second edge 346 becomes a forward edge.

In some embodiments, the upper portion may simply pivot around the axis C" without any upward or downward movement along this axis. In the illustrated embodiment, the base portion 318 may be said to have a pivot surface including a raised section 350 while the upper portion may be said to have a complementary pivot surface 352 including a recess 354. In the use position, the raised portion 350 extends into the recess 354 and may serve as a detent for positively locating the upper portion 332 in the use position. As the upper portion 332 is rotated from the use position to the storage position, the pivot surfaces slide on one another and cause the upper portion 332 to move upwardly somewhat as the raised portion 350 moves out of the recess 354. The upper portion may have a second recess 356, best shown in FIG. 22. When the upper portion reaches the storage position, the recess 350 may be received in the second recess to serve as a locator for positioning the upper portion in the storage position. The upper portion can move back downwardly when the recess 356 aligns with the raised portion 350. In order for the pivot surfaces to slide on one another, they must be shaped so as to allow smooth transitions. Alternatively, the raised portion 350 and/or the recesses 354 and 356 may be more squared off such that a user must first lift the upper portion prior to rotating the upper portion from the use position to the storage position and/or from the storage position to the use position.

As best shown in FIG. 23, the base portion may have a further tab 360 extending upwardly from its upper surface 326 and the upper portion 332 may have an aperture 362 for interaction with the tab 360 in the use position. This may further locate the upper portion in the use position. Further surface features on the upper portion 332 and base portion 318 may be provided for interaction.

As will be clear to those of skill in the art, the herein illustrated and discussed embodiments of the present invention may be altered in various ways without departing from the scope or teaching of the present invention. It is the following claims, including all equivalents, which define the scope of the invention.

We claim:

1. A mount for mounting an accessory to a rail of a weapon, the rail defining a longitudinal axis and having an upper face and a pair of opposed side faces, the mount comprising:

a base portion having an upper surface and a lower surface, the lower surface configured to engage a rail of a weapon so as to attach the base portion thereto, the base portion having a forward edge and a rearward edge with a fore-aft axis extending therebetween, the fore-aft axis being parallel to the longitudinal axis of the rail when the base portion is attached to the rail;

an upper portion having an upper surface and a lower surface, the upper surface of the upper portion comprising a mounting surface for receiving an accessory;

a pivot interconnecting the base portion and the upper portion, the pivot having a pivot axis for rotation of the upper portion with respect to the base portion between a use position and a storage position, the upper portion in the use position being disposed above the base portion and the upper portion in the storage position being disposed to a side of the base portion, the upper portion having a first edge that is a forward edge in the use position and a rearward edge in the storage position.

2. A mount in accordance with claim 1, wherein the pivot comprises a pivot shaft extending upwardly from the base portion and a pivot aperture in the upper portion, the pivot shaft being received in the pivot aperture.

3. A mount in accordance with claim 2, wherein the pivot further comprises a pivot surface defined on the base portion and a complimentary pivot surface defined on the upper surface, the pivot surfaces being in sliding engagement such that the pivot surfaces slide against each other when the upper portion pivots from the use position to the storage position.

4. A mount in accordance with claim 3, wherein the pivot surfaces are coaxial with the pivot shaft, one of the pivot surfaces having a raised portion extending therefrom, the other of the pivot surfaces having a recess defined therein, the raised portion being received in the recess when the upper portion is in the use position, the raised portion causing the upper portion to be moved upwardly away from the base portion as the upper portion is pivoted out of the use position.

5. A mount in accordance with claim 4, further comprising a second recess in the other of the pivot surfaces, the raised portion being received in the second recess when the upper portion is in the storage position.

6. A mount in accordance with claim 2, wherein:

the upper surface of base portion defines a horizontal plane, the pivot axis being generally perpendicular to the horizontal plane.

7. A mount in accordance with claim 1, further comprising a raised section defined on one of the base and the upper portion and a recess defined on the other of the base and the upper portion, the raised section being disposed in the recess when the upper portion is in the use position.

8. A mount in accordance with claim 1, wherein:

the upper surface of base portion defines a horizontal plane, the pivot axis being angled outwardly at a non-perpendicular angle with respect to the horizontal plane such that the upper portion in the storage position is disposed at a downwardly sloping angle with respect to the horizontal plane.

9. A mount in accordance with claim 1, wherein:

the base portion has a first side portion configured to engage a first side face of a rail of a weapon and a second side portion configured to engage a second side face of a rail of a weapon, the second side portion being opposite the first side portion;

one of the side portions being movable relative to the other of the side portions such that the side portions cooperate to selectively grip the rail of the weapon.

10. A mount for mounting an accessory to a weapon, the mount comprising:

a base portion having an upper surface and a lower surface, the lower surface configured to attach to a weapon so as to attach the base portion thereto, the base portion having a forward edge and a rearward edge with a fore-aft axis extending therebetween, the fore-aft axis being generally parallel to a longitudinal axis of the weapon when the base portion is attached to the weapon;

an upper portion having an upper surface and a lower surface, the upper surface of the upper portion comprising a mounting surface for receiving an accessory;

a pivot interconnecting the base portion and the upper portion, the pivot having a pivot axis for rotation of the upper portion with respect to the base portion between a use position and a storage position, the upper portion in the use position being disposed above the base portion and the upper portion in the storage position being disposed to a side of the base portion, the upper portion having a first edge that is a forward edge in the use position and a rearward edge in the storage position.

* * * * *